US006386398B2

(12) United States Patent
Drake, Jr.

(10) Patent No.: US 6,386,398 B2
(45) Date of Patent: May 14, 2002

(54) DISPENSER

(75) Inventor: Jerry R. Drake, Jr., Tidioute, PA (US)

(73) Assignee: Osram Sylvania Inc., Danvers, MA (US)

( * ) Notice: Subject to any disclaimer, the term of this patent is extended or adjusted under 35 U.S.C. 154(b) by 0 days.

(21) Appl. No.: 09/808,620

(22) Filed: Mar. 14, 2001

Related U.S. Application Data

(60) Provisional application No. 60/203,174, filed on May 8, 2000.

(51) Int. Cl.[7] ..... B65D 88/54
(52) U.S. Cl. ..... 222/334; 222/405
(58) Field of Search ..... 222/260, 261, 222/262, 333, 334, 389, 386, 405

(56) References Cited

U.S. PATENT DOCUMENTS 3,601,285 A * 8/1971 Leger ..... 222/334
3,758,003 A * 9/1973 Kautz et al. ..... 222/334
3,982,669 A * 9/1976 Moore ..... 222/333
4,090,640 A * 5/1978 Smith et al. ..... 222/260
4,635,820 A * 1/1987 Marshall ..... 222/333
4,693,286 A * 9/1987 Lock et al. ..... 222/389
5,312,028 A * 5/1994 Hume ..... 222/389
5,361,940 A * 11/1994 Miller et al. ..... 222/389
6,046,437 A * 4/2000 Frates ..... 222/262

* cited by examiner

*Primary Examiner*—Philippe Derakshani
*Assistant Examiner*—Thach H Bui
(74) *Attorney, Agent, or Firm*—William H. McNeill

(57) ABSTRACT

A dispenser for dispensable materials comprises a compressible supply of the dispensable materials and a rigid holding unit having a given cross-section for containing the compressible supply of the dispensable materials. An actuator plate having a given cross-section is positioned in the rigid holding unit. An outlet for the dispensable materials is connected to the compressible supply and has a fitting connected to and extending through the actuator plate. An apparatus is supplied for engaging the actuator plate and applying pressure solely thereto to cause the dispensable materials to be expelled from the compressible supply.

7 Claims, 1 Drawing Sheet

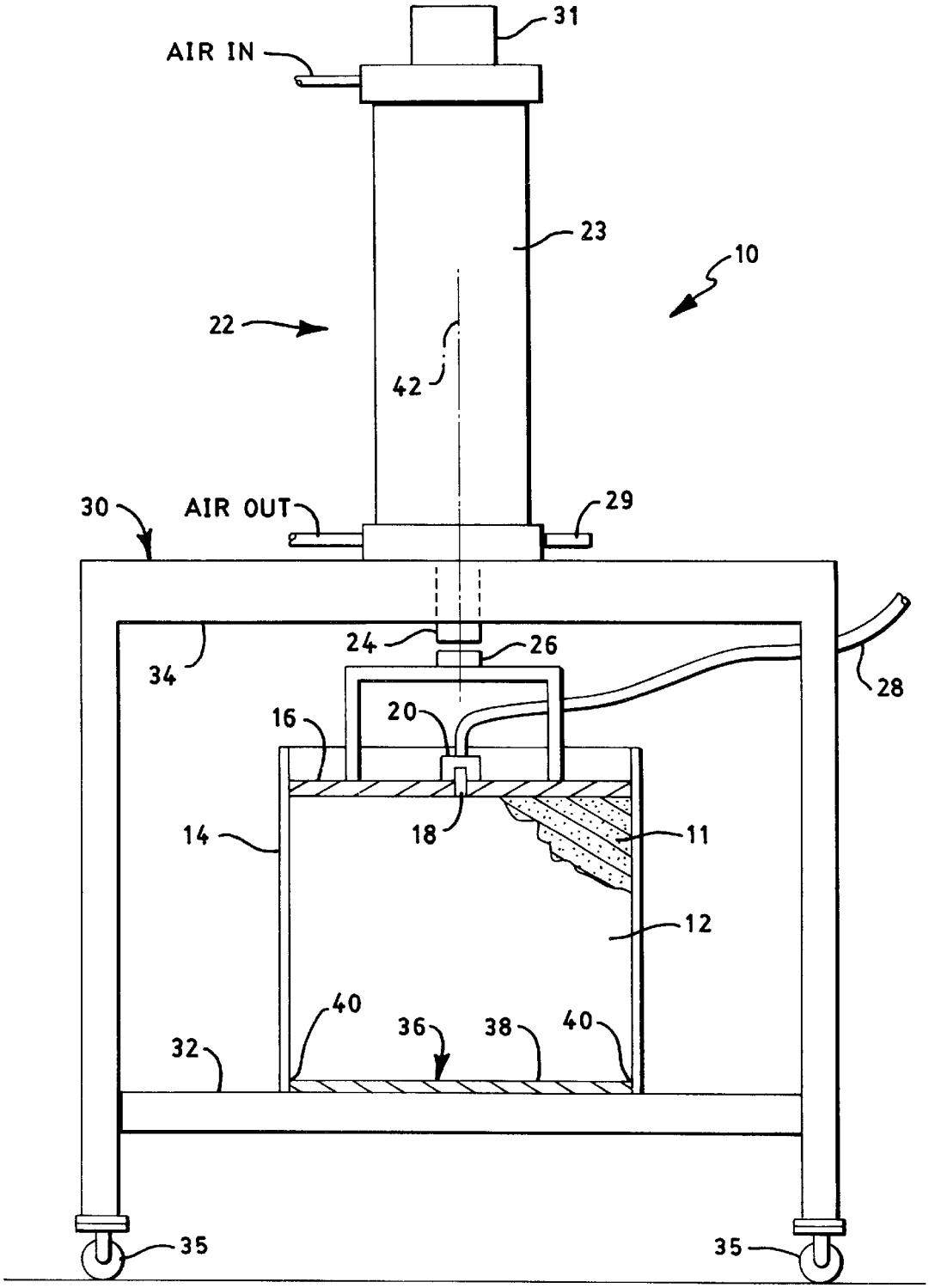
31
AIR IN
23
10
22
42
30
AIR OUT
29
24
26
34
28
16
20
14
18
11
12
40
36
38
40
32
35
35

DISPENSER

This application claims priority from Provisional Patent Application No. 60/203,174, filed May 8, 2000.

TECHNICAL FIELD

This invention relates to dispensers of dispensable materials and more particularly to dispensers of relatively viscous sealant materials. Still more particularly the invention relates to dispensing materials from relatively large supplies thereof, e.g., amounts of materials in the range of 5 gallons or more and weights in the range of 40 pounds.

BACKGROUND ART

Dispensing liquid or viscous materials such as adhesives or sealants from a supply thereof to a remote location is a fundamental part of many manufacturing operations. When the supply of the materials being dispensed is present in quantities having great bulk or weight it is important that the means for delivering the material should operate in a relatively efficient manner. Under the methods of the prior art it was usual for such materials to be dispensed from a pressurized container; however, where the air pressure required to dispense the material is great, it often happens that the pressurized air would leak past required sealant bladder seals into the dispensable material creating air bubbles therein. In cases where the dispensable material is a sealant, the air bubbles would cause the object being provided with the sealant to be rejected, greatly increasing the cost of the product. Further, once air bubbles were detected in the material, the remainder of the material would have to be scrapped which also increased the cost of the products being sealed. In a particular instance wherein the dispensable material is a sealant that is being applied to an electrical connector, the sealant (at the time of filing of this application) has a cost of $878 for 40 pounds of material and air bubbles entering the supply often caused half of the material to be unusable.

DISCLOSURE OF INVENTION

It is, therefore, an object of the invention to obviate the disadvantages of the prior art.

It is another object of the invention to enhance the dispensing of liquid or viscous materials.

It is yet another object of the invention to prevent the entrance of air bubbles into dispensed materials.

These objects are accomplished, in one aspect of the invention, by the provision of a dispenser for dispensable materials that comprises a compressible supply of the dispensable materials and a rigid holding unit having a given cross-section for containing the same. An actuator plate having the same cross-section as the rigid holding unit is positioned in the rigid holding unit. An outlet for the dispensable materials is connected to the compressible supply, and an apparatus is provided for engaging the actuator plate and applying pressure solely to the actuator plate to cause the dispensable materials to be expelled from the compressible supply. The apparatus for engaging the actuator plate and applying pressure includes a shaft and the shaft freely engages said actuator plate. By "freely engaging" is meant a system wherein there is no fixed, permanent coupling between the shaft and the actuator plate so that the shaft can be subsequently retracted without disturbing the position of the actuator plate.

In a preferred embodiment of the invention the outlet for the dispensable material exits through a fitting provided in the actuator plate.

BRIEF DESCRIPTION OF THE DRAWINGS

The single FIGURE is an elevational view of an embodiment of the invention.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Referring now to the drawings with greater particularity, a dispenser 10 for dispensable materials, such, for example, as a curable sealant 11, comprises a compressible supply 12 of the dispensable materials. A rigid holding unit 14 has a given cross-section, such as circular, and contains the compressible supply 12. The unit 14 can be of metal or hard plastic or other suitable material. An actuator plate 16 has the same cross-section as the holding unit 14 and is operatively positioned therein. The compressible supply of dispensable materials, which can be, for example, carried in a flexible plastic container, has an outlet 18. In a preferred embodiment of the invention, the outlet 18 is connected to a fitting 20, which is connected to the actuator plate 16. If desired, the outlet 18 could be exited through the base. An apparatus 22, preferably in the form of fluid motor 23, such, for example, as an air cylinder, has a shaft 24, which freely engages a projection 26 on actuator plate 16. When actuated, the apparatus 22 applies pressure to the actuator plate 16 and thus to the dispensable materials contained in the compressible supply 12, causing the dispensable materials to be expressed from the supply to a remote location, via hose 28. When an air cylinder is employed, suitable air-in and air-out connections are provided, as shown in the illustration. Also, while automated operation of the apparatus would certainly be most efficient, a manual valve 29 is provided for controlling the apparatus if desired or when necessary for set-up operations. Additionally, a warning light 31 can be provided, preferably on the top of motor 22, to indicate when the supply of dispensable materials is running low.

In a preferred form, the dispenser 10 comprises a frame 30 having a bottom 32, and a top 34. To make the entire dispenser portable, wheels 35 can be attached in a suitable location. The bottom 32 has a centering device 36, which, in this instance, takes the form of a circular disk 38 that fits inside a lip 40 formed on rigid holding unit 14.

The centering device 36 positions the rigid holding unit 14 on a vertical axis 42 that also provides the axis for the fluid motor 23.

This apparatus greatly improves the efficiency of the dispensing process. The apparatus can be started and stopped without effecting the operation and, because it is the actuator plate that puts the actual pressure upon the sealant material, it is not possible for air bubbles to enter the material, thus resulting in complete utilization thereof.

While there have been shown and described what are at present considered the preferred embodiments of the invention, it will be apparent to those skilled in the art that various changes and modifications can be made herein without departing from the scope of the invention as defined by the appended claims.

What is claimed is:

1. A dispenser for dispensable materials comprising: a compressible supply of said dispensable materials; a rigid holding unit having a given cross-section containing said compressible supply of said dispensable materials; an actuator plate having said given cross-section positioned in said rigid holding unit; an outlet for said dispensable materials connected to said compressible supply and having a fitting connected to and extending through said actuator plate; and an apparatus for engaging said actuator plate and applying pressure solely thereto to cause said dispensable materials to be expelled from said compressible supply, said apparatus comprising a fluid motor and a shaft, said shaft freely engaging said actuator plate.

2. The dispenser of claim 1 wherein said compressible supply, said actuator plate and said apparatus for engaging said actuator plate are vertically aligned along an axis.

3. The dispenser of claim 2 wherein said dispenser includes a frame having a bottom and a top and said bottom is provided with a centering device for aligning said compressible supply with said axis.

4. A dispenser for dispensable materials comprising: a compressible supply of said dispensable materials; a rigid holding unit having a given cross-section containing said compressible supply of said dispensable materials; an actuator plate having said given cross-section positioned in said rigid holding unit; an outlet for said dispensable materials connected to said compressible supply; and an apparatus for engaging said actuator plate and applying pressure solely thereto to cause said dispensable materials to be expelled from said compressible supply, said apparatus for engaging said actuator plate and applying pressure including a shaft and wherein said shaft freely engages said actuator plate.

5. The dispenser of claim 4 wherein said apparatus for engaging said actuator plate and applying pressure comprises a fluid motor.

6. The dispenser of claim 5 wherein said compressible supply, said actuator plate and said apparatus for engaging said actuator plate are vertically aligned along an axis.

7. The dispenser of claim 6 wherein said dispenser includes a frame having a bottom and a top and said bottom is provided with a centering device for aligning said compressible supply with said axis.

* * * * *